United States Patent [19]

Hirsch et al.

[11] Patent Number: 4,756,141

[45] Date of Patent: Jul. 12, 1988

[54] APPARATUS FOR ROTATING AND COMPRESSING A STACK OF PADS

[75] Inventors: John L. Hirsch, Sheboygan Falls; Martin J. Osypowski, Sheboygan, both of Wis.

[73] Assignee: Curt G. Joa, Inc., Sheboygan Falls, Wis.

[21] Appl. No.: 41,150

[22] Filed: Apr. 22, 1987

[51] Int. Cl.[4] ..... B65B 1/24

[52] U.S. Cl. ..... 53/438; 53/529; 100/240; 100/292

[58] Field of Search ..... 53/436, 438, 439, 446, 53/447, 523, 527, 528, 529, 540, 544, 530; 100/177, 178, 185, 223, 240, 291, 292

[56] References Cited

U.S. PATENT DOCUMENTS

| | | | |
|---|---|---|---|
| 606,478 | 6/1898 | Tremaine et al. | 100/178 X |
| 1,870,533 | 8/1932 | Scott et al. | 53/438 |
| 2,324,930 | 7/1943 | Joa . | |
| 2,795,909 | 6/1957 | Ade | 53/529 |
| 4,399,905 | 8/1983 | Lance et al. . | |
| 4,492,070 | 1/1985 | Morse et al. | 53/438 |
| 4,577,453 | 3/1986 | Hofeler | 53/438 |

*Primary Examiner*—Robert L. Spruill
*Assistant Examiner*—Steven P. Weihrouch
*Attorney, Agent, or Firm*—Fuller, Puerner & Hohenfeldt

[57] ABSTRACT

A machine for conditioning a stack of pads, such as sanitary pads, for packaging includes a rotor. Radially extending chambers having closed sides and open front and rear ends are fastened to the rotor. There is a compressor plunger in each chamber. The plungers are carried on guide rods extending from cam follower brackets. A stationary cam plate is mounted perpendicular to the rotational axis of the rotor. The follower rollers are spring biased into contact with the periphery of the cam plate. The chambers are incremented in angular steps starting with a position in which the chamber is stopped momentarily for being loaded with a stack of pads at which time its plunger is retracted. As the loaded chamber increments in two angular steps to an unloading position, the plunger is driven out by the cam to compress the stack. When the chamber rotates from loading position to unloading position, the pads are effectively turned so they are standing on their edges in the unloading position.

3 Claims, 3 Drawing Sheets

APPARATUS FOR ROTATING AND COMPRESSING A STACK OF PADS

BACKGROUND OF THE INVENTION

The invention pertains to apparatus for rotating and compressing a stack of soft pads, such as sanitary pads, so the stack can be easily fitted into a package such as a carton or a bag.

After sanitary pads are discharged from the pad forming machine, they eventually arrive at a stacker. In some cases, the pads are folded on a line transverse to their length so that the pads become one-third as long and three times as thick. In some cases, after having been folded, the pads are inserted in individual packages such as sealed bags before they are entered into the stacker. When a predetermined number of pads are accumulated at the discharge station of the stacker, a synchronously driven pusher pushes the stack into a next machine stage.

When the pads leave the stacker, they are stacked with their broader faces in interfacing relationship with each other. Usually, a vertical line would be perpendicular to the faces of the pads in the stack at this time. For entering them in a cartoner or a bag making machine it is desirable, however, to have the stack rotated so the individual pads are standing on their edges for being pushed edgewise into a bag or a carton.

SUMMARY OF THE INVENTION

An objective to the invention is to provide a machine that accepts a stack of pads in which the broad faces of the pads are interfaced with each other and which rotates or swings the stack until it arrives at an unloading station where the pads are standing on their edges and the stack is compressed while it is being rotated from a loading station to the unloading station.

In general terms, the new pad rotater and compressor is comprised of a power driven rotor whose rotational axis extends horizontally. A plurality of chambers are mounted to the rotor and are equiangularly spaced around its axis of rotation. The chambers extend radially. They have radially extending opposite side walls that are spaced apart circumferentially sufficiently to receive a closely fitting stack of pads between them. The ends of the chambers least remotely and most remotely from the axis of rotation are closed. Each chamber has a plunger which is reciprocated radially inwardly and outwardly in the chamber by way of followers that run on a stationary cam surface. The configuration of the cam is such that the plunger of the one chamber that is aligned with the stack loading station is reciprocated to its most radially inward position. As the one chamber is incremented rotationally toward the unloading station, the reaction between the cam and the cam follower causes the plunger to be driven radially outwardly to thereby compress the stack of pads. Rotation continues through 90° from the pad loading station to a pad unloading station where the pads arrive standing on their edges in readiness for being pushed out of the chamber automatically and into some kind of package such as a carton or a bag. An indexing device is operative to turn the rotor in equiangular increments or steps so that the chambers will be standing still while one is being loaded and another is being unloaded.

A more detailed description of a preferred embodiment of the invention will now be set forth in reference to the drawings.

DESCRIPTION OF A PREFERRED EMBODIMENT

Figure 1:
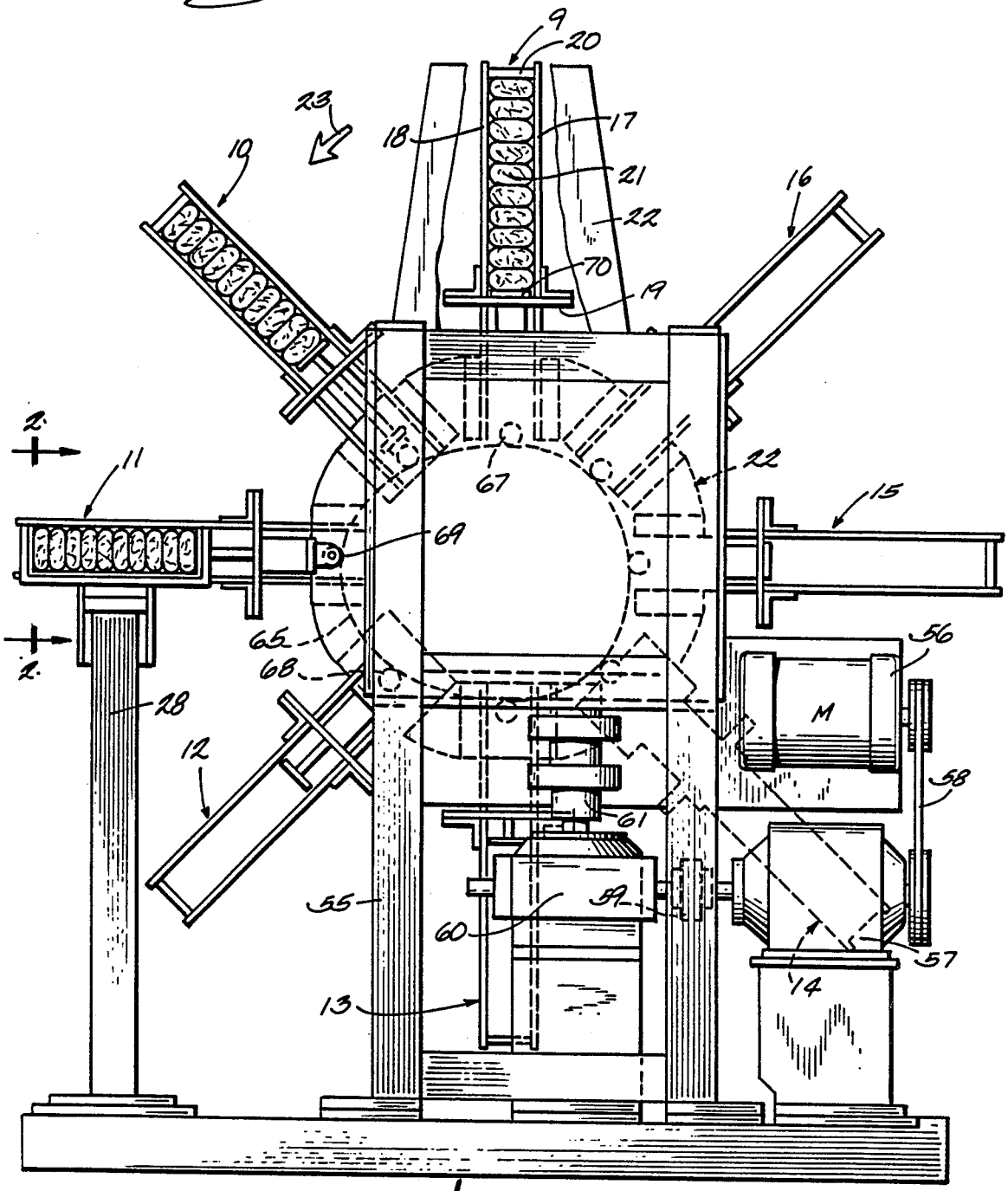
FIG. 1 is a front elevational view of the new apparatus for rotating and compressing a stack of pads during transit from a loading station, where the pads are stacked with their broad faces lying in horizontal planes, to an unloading station where the pads are compressed and standing on their edges.
Figure 3:
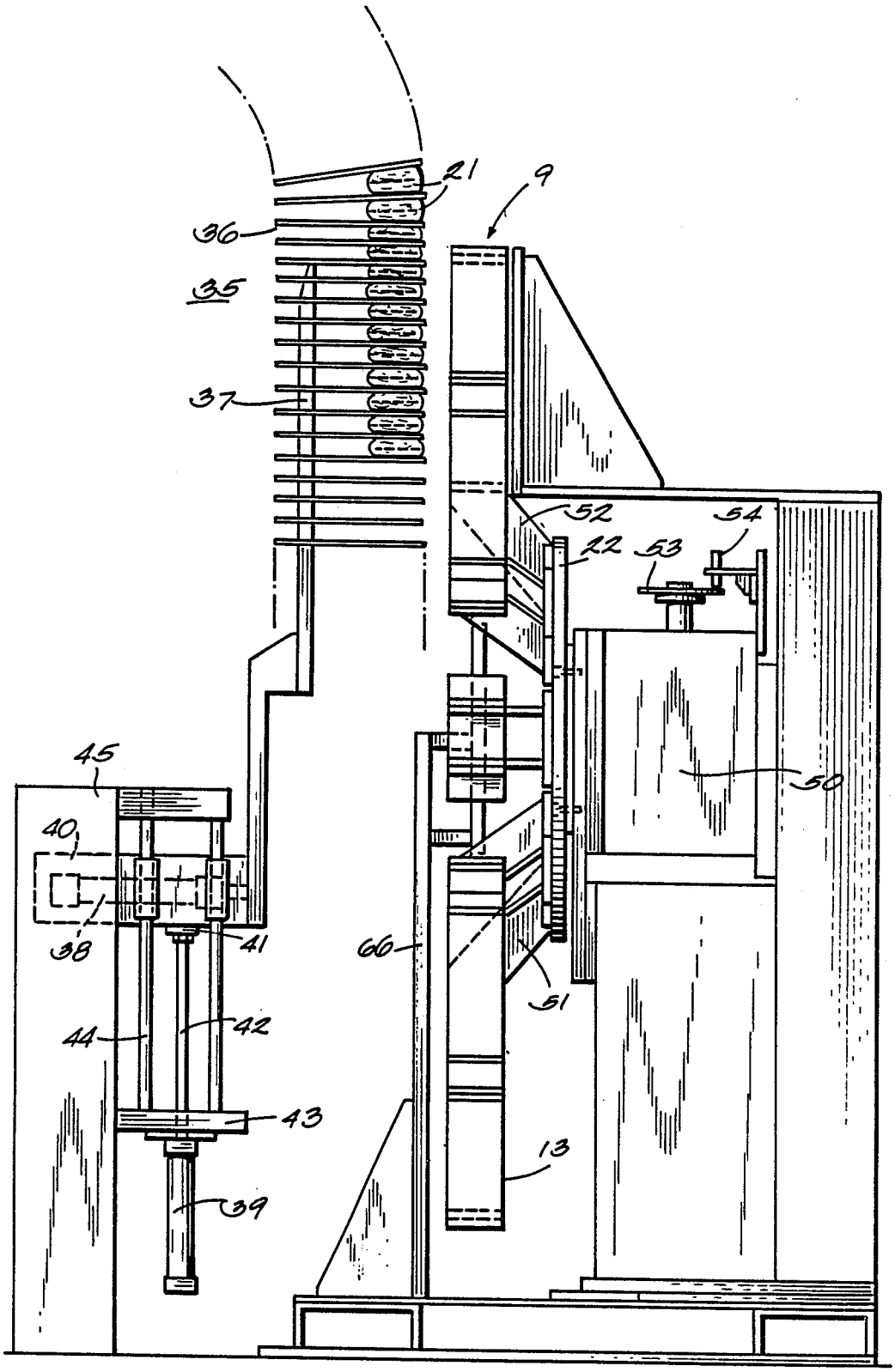
FIG. 3 is a side elevational view of the apparatus of FIG. 1 shown in conjunction with the output stage of a pad stacker which is located at the loading station for the new stack rotater and compressor.

Attention is invited to FIGS. 1 and 3. These figures show that the new pad turning and compressing machine has 8 chambers 9–16. Chamber 9 is typical. It comprises 2 sidewalls 17 and 18, a radially inward end wall 19 and a radially outward end wall 20. Sidewalls 17 and 18 are spaced apart by an amount equal to the width of the pads comprising the stack marked 21 in chamber 9. At the loading station there is a stop wall 22 which assures that the pads will not be pushed through the chamber, such as chamber 9, which is in loading position as a result of being pushed into the chambers at rather high speed.

As will be explained in greater detail later, the stack of pads that is pushed into the chamber 9 in loading position, is orbited in the direction of the arrow 23 in FIG. 1 until the chamber arrives in the position of chamber 11 where the pads are pushed out of the chamber. While chamber 9 is being incremented rotationally from loading position through the position of chamber 10 to unloading position wherein chamber 11 is presently disposed, the stack of pads in the chamber is compressed to reduce its overall height which becomes its width after being rotated. Besides compression, another function is performed during rotation of the chambers from loading position to unloading position. This function results in the pads standing on their edges when they are in unloading position as exhibited in chamber 12 in FIG. 1. When the pads are inserted in chamber 9 in the loading position, they are stacked with their broad faces interfacing each other in horizontal orientation while the edges are lying on a substantially vertical plane. When they arrive in unloading position as is the case with chamber 11, the pads have been rotated 90° and are standing on their edges and are compressed in preparation for being pushed out of the chamber and into a funnel that directs them to a bag or carton as illustrated in FIG. 2.

Figure 2:
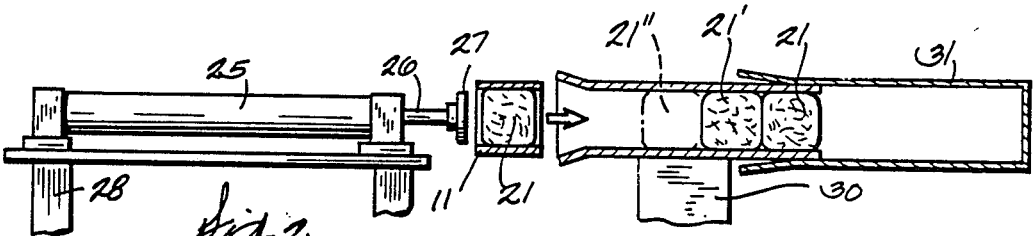
FIG. 2 is a diagram of a pusher for forcing a stack of pads, or multiple stacks of pads in some machines, out of the compression chambers.

FIG. 2 shows a known type of mechanism for pushing a stack out of a chamber in the present position of chamber 11. It comprises a pneumatic cylinder 25 having a piston rod 26 on which there is a pusher plate 27. The cylinder is mounted on a stand 28. The chamber from which the pads 21 standing on their edges are unloaded is marked 11 in FIG. 2 as it is in FIG. 1. A funnel 29 used for packaging is depicted in FIG. 2 but is omitted from FIG. 1. The funnel is on a stand marked 30. Presently, there is a carton 31 slipped over funnel 29. When the chambers get into the angular position of the one marked 11 in FIG. 1, pneumatic cylinder 25 is activated to cause the stack of pads in chamber 11 to be pushed into carton 31. The first and second stacks 21 and 21' to arrive in unloading position are pushed into funnel 29 with short strokes of piston rod 26. A longer stroke of piston rod 26 pushes the third stack 21" and the first and second stacks 21 and 21' into the carton. In the particular design shown for illustration but not limitation, there would be three stacks, 10 pads in each, making a total of 30 pads in one carton. The packing machine depicted in FIG. 2 is essentially schematic to show the ultimate result achieved. In reality, apparatus, not shown, may be provided for depositing cartons in position and removing filled cartons which would then be closed and sealed.

FIG. 3 shows the principal parts of the apparatus for accumulating stacks of pads and for pushing them into chamber 9 which is in the loading position. The stacker apparatus is designated generally by the numeral 35. The stacker is conventional. It is functionally similar to stackers shown in U.S. Pat. Nos. 2,324,930 and 4,399,905. As in the known stackers, there are closed loop conveyor chains, not shown. There are a series of paddles pivotally connected to the closed loop conveyor chains throughout their lengths. Somewhere along the path through which the paddles translate, they follow an arc and in so doing their outer ends spread out. At this time, pads are fed in between consecutive pairs of paddles. In FIG. 3, assume the paddles 36 and the pads 21 are moving downwardly. Actually, there would be an unbroken series of pads leading back to the point where the pads are inserted between the paddles. In this case, the orbiting chambers 9 are adapted to receive a stack containing 10 pads as illustrated. When the stack of 10 pads aligns between the upper and lower ends of the chamber, a vertically extending pusher rod 37 moves quickly to the right, as viewed in FIG. 3 so the stack enters chamber 9. The pusher rod then drops down at a speed faster than the paddles 36 are moving vertically and then it retracts and shifts upwardly in readiness for pushing the next stack to accumulate in the next consecutive chamber. There are two pneumatic cylinders 38 and 39 which manipulate pusher rod 37. Cylinder 38 can advance and retract the pusher rod in horizontal planes. This cylinder is mounted on a carriage 40 which is supported on the end 41 of piston rod 42 in cylinder 39. The cylinder 39 is mounted on a bracket 43 which has parallel guide rods 44 fastened to it. The carriage 40 is movable vertically on these guide rods under the influence of cylinder 39. The upper ends of the guide rods are anchored in a frame 45. Piston rod 42 of cylinder 39 is presently extended so that pusher rod 37 is in its highest attainable position. Next, cylinder 38 will be pressurized to drive the pusher rod 37 to the right. Then, cylinder 39 will be activated to retract piston rod 42 and pull pusher rod 37 down. After that, cylinder 38 is activated again to retract the pusher rod to the left and as a final step, cylinder 39 is activated again to restore the pusher rod 37 in its uppermost position in readiness for loading another chamber.

Figure 4:
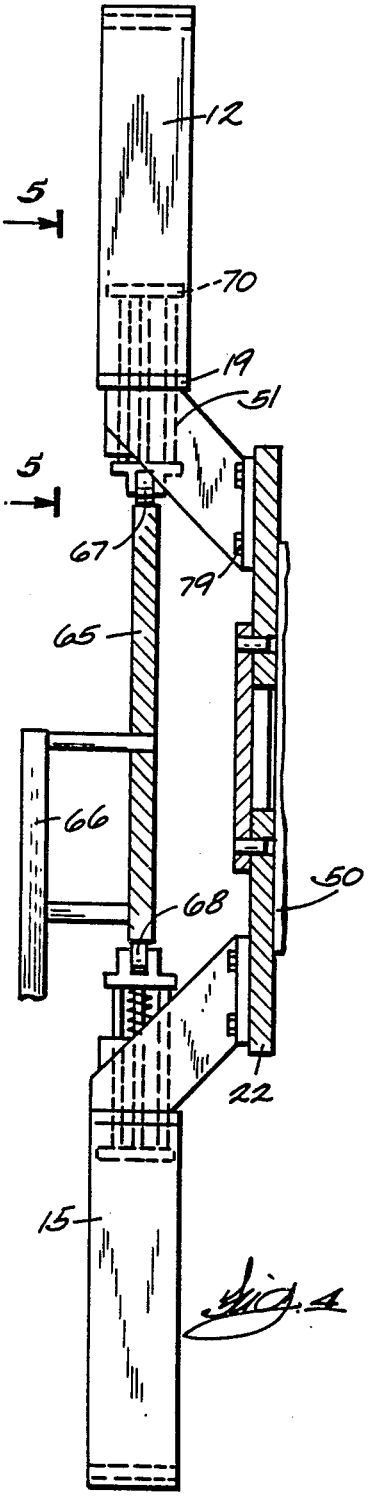
FIG. 4 is an isolated view, partly in section, and with parts removed, to illustrate coaction between the follower driven plungers in the stack containing chambers and the stationary cam which the followers follow, this figure also shows the manner in which the stack holding chambers are indexed or incremented rotationally.

As can be seen best in FIGS. 3 and 4, the chambers 9–16 are mounted to rotor 22 which is driven rotationally through an indexer 50. The rotor 22 has 8 identical brackets such as the two marked 51 and 52, extending from it. The 8 chambers 9–16 are mounted, respectively, on the 8 brackets. Thus, when the rotor 22 is driven in a step-by-step fashion through the indexer, the chambers orbit through 45° for every step. The loading and unloading means are kept in synchronism with a signal generator comprised of a semi-circular rotating disk 53 that cooperates with a photosensor 54. Timing of multi-function apparatus with photosensors that serve as a clock pulse generator are sufficiently well known to obviate the need for discussing them in any greater detail.

As shown in FIG. 1, the components for driving the rotor and hence, the chambers 9–16 rotationally, are mounted on a floor mounted frame 55. The drive train for incrementing rotor 22 and, hence, the chambers in 45° steps are mounted on frame 55. The drive train depicted in FIG. 1 comprises an electric motor 56 which drives a clutch-brake unit 57 through the agency of a belt 58. The output shaft of clutchbrake 57 is coupled by means of coupling 59 to the input shaft of a speed reducer 60. The output shaft of the speed reducer is coupled by way of a coupling 61 to the input of the indexer 50. The indexer 50 assures that the chambers will be incremented to the proper position and stopped for an instant to allow for loading and unloading the stacks of pads from the machine.

As previously indicated, the pads in each stack are not only rotated and stood edgewise while the chamber containing the pads is rotated from loading to unloading position but, in addition, the pads are also compressed at this time so that they can be pushed into and packaged in a carton or bag without having the pads catch on the edges of the package. The manner in which compression is accomplished concurrently with rotation will now be discussed.

The compression mechanism comprises a cam plate 65 whose profile can be seen best in FIG. 1. The profile of the right half of the cam is semi-circular and the left half is oblong. As shown in FIG. 4, cam plate 65 is supported in a stationary fashion on a bracket structure 66. As is the case in chamber 9, every one of the chambers contains a flat pusher plate 70 which is pushed toward the closed end 20 of each chamber to effect compression of the pads when they are in transit between loading position as is chamber 9 and unloading as is chamber 11. The pusher plates 70 are actuated by cam follower rollers such as the one marked 67 rolling on the periphery of stationary cam plate 65.

Figure 5:
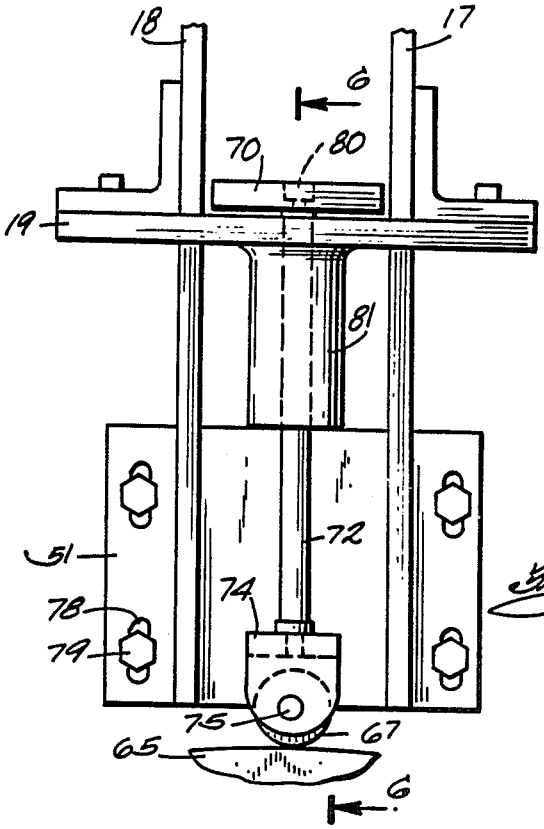
FIG. 5 is a fragmentary enlarged view of a chamber, the bracket for supporting the chamber, the plunger in the chamber and the cam follower for actuating it and a segment of the cam which causes the plungers to reciprocate.
Figure 6:
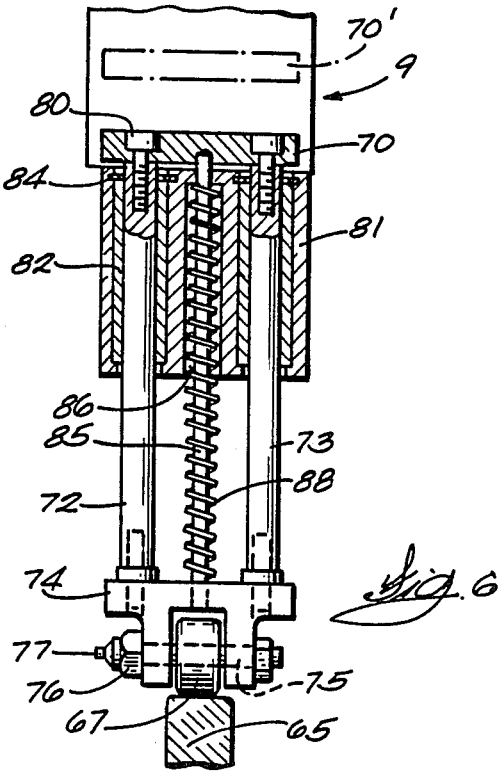
FIG. 6 is a detailed sectional view of the stack holding chamber, the plunger in the chamber and the cam drive mechanism for the plunger.

A typical pusher plate 70 operating mechanism is depicted in detail in FIGS. 5 and 6. FIG. 5 shows that the pusher plate 70 fits with some clearance between the side walls 17 and 18 of a typical chamber. In an actual embodiment, the side walls are made of a transparent plastic material. The side walls are fastened to angle brackets 71 which are bolted to a metal plate 19. The metal plate 19 closes off the radially inward end of the stack containing chamber as previously mentioned. Plate 19 is a part of a bracket 51 which supports the stack chambers on rotor 22. As can be seen in FIG. 6, pusher plate 70 is supported on two guide rods 72 and 73. The lower ends of guide rod 72 are fastened to a follower roller bracket 74. There is a shaft 75 spanning across bracket 74 and a cam follower roller 67 is journaled on this shaft. The shaft is secured with internally threaded nuts such as the one marked 76. The latter has a lubrication fitting 77 mounted on it. Cam roller 67 is shown in contact with cam 65 in FIG. 6. Bracket 51 is provided with slots such as the one marked 78 so it can be adjusted radially inwardly and outwardly on rotor 72 by loosening clamping bolt 79 and sliding the bracket 51 in the proper direction to have the pusher plate 70 retracted to its desirable inner limit when the chambers have arrived in chamber loading position as is the case in chamber 9 in FIG. 1.

As shown in FIG. 6, pusher plate 70 is fastened to guide rods 72 and 73 by means of socket headed machine screws 80. Each bracket 51 has an oblong body 81 formed integrally with it. As is evident in FIG. 6, there are two bushings 82 and 83 in which guide rods 72 and 73 reciprocate. The bushings are retained by snap rings such as the one marked 84. In FIG. 6, cam follower roller 67 is on the shortest radius of stationary cam plate 65 so that pusher plate 70 is retracted to its radially inward limit. When the chamber 9 orbits around to unloading position, cam follower roller 67 will be where the cam follower roller 69 is located in FIG. 1, in which cas the pusher plate 70 will be shifted to the position in which it is shown in phantom lines in FIG. 6, where it is marked 70'. There is a rod 85, visible in FIG. 6, whose lower end is threaded into bracket 74 and whose upper end is threaded into pusher plate 70. The body 81 has a deep counterbore 86. It has a blind end 87. A preloaded coil spring 88 is interposed between the blind end 87 of counterbore 86 and the top of follower roller bracket 74. Since body 81 is part of the bracket 51 that supports chamber 9 and the bracket is fixed on rotor 22, the spring 88 will develop a reactive force which will keep cam roller 67 pressed against the periphery of cam plate 65. When the guide rods 72 and 73 and compressor plate 70 are pushed radially outwardly, preloaded spring 86 is compressed further. When the cam follower roller 67 passes over the longest radius point on the cam profile, spring 88 is allowed to expand so as to press the follower roller 67 against cam 65.

Although a preferred embodiment of the new pad stack reorientating and compressing device has been described in considerable detail, such description is intended to be illustrative, rather than limiting, for the invention may be variously embodied and is to be limited only by interpretation of the claims which follow.

We claim:

1. Apparatus for rotating and compressing a stack of pads which have opposed broad faces and opposed edges, comprising:

rotor means, means for rotating said rotor means through unfiorm angular increments and for stopping said rotor means at the end of each angular increment, a plurality of chambers comprised of radially extending spaced apart side walls and a wall at their radially outermost ends mounted to said rotor means in equiangular spaced apart relationship around the rotational axis of the rotor means for rotating in a circular path, stationary cam means inside of said circular path, a plunger arranged in each chamber between said side walls for reciprocating radially between said side walls and cam follower means coupling said plungers, respectively, to said cam means for causing said reciprocation as the chambers rotate, said cam means operating said follower means such that when any one of the chambers is incremented to a pad loading position, at which said chamber is loaded with a stack in which the broad faces of the pads are substantially horizontal, the plunger in the chamber being loaded is retracted radially inwardly and while said one chamber is incremented toward a pad unloading position said plunger is moving radially outwardly to compress said stack by the time the stack arrives at the unloading position.

2. Apparatus according to claim 1 in which:

said chambers are constructed such that when said any one chamber is at said loading position it is extending vertically to receive a stack of pads in which said broad faces are standing on each other and lying in horizontal planes and when said stack is incremented to said unloading position the pads in said stack are compressed and standing on their edges.

3. A method of preparing for packaging stacks of pads in which each pad has generally flat opposed faces and opposed edges, said method comprising the steps of:

pushing a stack of pads into one of a succession of elongated angularly spaced apart rotatable chambers while said one chamber is stopped in a loading position wherein it projects vertically away from a center of rotation and the pads in the stack overlay each other with their flat faces lying on horizontal planes and their corresponding opposed edges spaced from each other in a horizontal direction, rotating said chambers about said axis of rotation together such that said one chamber moves through an arc from loading position toward unloading position and during the course of rotation moving a plunger radially in said chamber to compress the stack therein, and interrupting rotation momentarily when said one chamber has rotated 90° to unloading position from said loading position and said chamber is projecting horizontally from said center of rotation such that said flat faces of the pads are vertical and said pads are standing on their edges, and pushing said stack of pads out of said one chamber.

* * * * *